United States Patent [19]

LaRocca

[11] Patent Number: 4,660,309

[45] Date of Patent: Apr. 28, 1987

[54] CHANGEABLE CHARACTER DISPLAY DEVICE

[75] Inventor: John LaRocca, Fairfield, N.J.

[73] Assignee: Trans-World Manufacturing Corp., East Rutherford, N.J.

[21] Appl. No.: 795,622

[22] Filed: Nov. 6, 1985

[51] Int. Cl.[4] ..... G09F 3/20

[52] U.S. Cl. ..... 40/5; 40/490; 40/491; 40/529

[58] Field of Search ..... 40/5, 490, 491, 529

[56] References Cited

U.S. PATENT DOCUMENTS

| | | | |
|---|---|---|---|
| 464,006 | 12/1891 | Brunell | 40/5 |
| 1,459,532 | 6/1923 | Harlan | 40/5 |
| 1,527,382 | 2/1925 | Snyder | 40/529 |
| 1,754,383 | 4/1930 | Brown | 40/491 |
| 2,105,685 | 1/1938 | Cox | 40/5 |
| 2,770,900 | 11/1956 | Smith | 40/491 |
| 2,822,631 | 2/1958 | Lynch | 40/5 |
| 2,974,433 | 3/1961 | Litzinger | 40/490 |

FOREIGN PATENT DOCUMENTS

| | | | |
|---|---|---|---|
| 664182 | 6/1963 | Canada | 40/490 |
| 596286 | 8/1925 | France | 40/491 |
| 840645 | 4/1939 | France | 40/491 |
| 10694 | 1/1977 | Japan | 40/491 |
| 429872 | 8/1967 | Switzerland | 40/491 |

*Primary Examiner*—Gene Mancene
*Assistant Examiner*—J. Hakomaki
*Attorney, Agent, or Firm*—Ostrolenk, Faber, Gerb & Soffen

[57] ABSTRACT

A plurality of flexible strips are included in a changeable character display device. Each strip has a series of display portions that are longitudinally arranged on a strip. A guide panel of the device includes respective pairs of apertures arranged laterally in a row. Each respective pair of apertures is associated with a respective one of the flexible strips. Each flexible strip is arranged to have a viewable display portion situated between the individual ones of the associated pair of apertures whereby the respective displayed portions of the plurality of strips form lateral rows. The non-displayed portions of the respective flexible strips extend rearwardly through the associated pair of apertures. A guide channel member includes a laterally-extending channel that receives the non-displayed portions of the flexible strips and clusters them together in a lateral direction. A further row of characters which are vertically spaced from the first row may be included in the display device while being closely spaced to the first row. Rapid and accurate changing of the characters of each flexible strip is facilitated by alignment apertures in the flexible strip situated between adjacent display portions on the strip.

13 Claims, 6 Drawing Figures

CHANGEABLE CHARACTER DISPLAY DEVICE

BACKGROUND OF THE INVENTION

The present invention relates to a changeable character display device, and more particularly to a display device wherein changeable characters are provided on thin strips of material.

Display devices are often used to display the price of an item that may vary from day to day. Typical display devices that are known provide a lateral row of changeable characters. The changeable characters are implemented by arranging a plurality of vertically-oriented strips side by side. A display window or windows of a mask then permit viewing of only a single character of each of the side-by-side strips.

Known display devices of the foregoing type are entirely mechanical in construction, and thus avoid the complexities of electrical components. However, the known display devices still have shortcomings of being complex in construction or difficult in the operation of changing the displayed characters.

Known display devices utilizing vertically-oriented, side-by-side strips are described, for example, in U.S. Pat. Nos. 3,159,937; 4,095,359 and 4,337,588. The display devices of these patents are complex in construction, since each device requires strips with different characters thereon to have both ends specially treated so as to be pre-stressed and pre-coiled.

U.S. Pat. Nos. 1,527,382 and 2,081,265 describe additional display devices in which vertically-oriented strips are placed side by side and in which a lateral row of characters of strips is viewable through a display window. The characters of the display devices of these patents are difficult to change and require complex structure to implement the change of characters.

Moreover, the display devices of the patents cited above have the common feature of vertically-oriented strips that are oriented side by side. A display window or windows permits viewing of a lateral row of display characters. If it is desired to include in a display device a plurality of lateral rows of displayed characters, one above the other, considerable vertical separation between adjacent rows is required. This limits the amount of changeable display information that can be incorporated into a display device.

SUMMARY OF THE INVENTION

Accordingly, an object of the invention is to provide a changeable character display device that is simple in construction.

A further object of the invention is to provide a changeable character display device that is mass producible.

Another object of the invention is to provide a changeable character display device in which the displayed characters may be changed easily, rapidly and accurately.

A still further object of the invention is to provide a changeable character display device in which a plurality of lateral rows of display characters arranged one above the other may be provided and in which close spacing between the vertically-offset rows is possible.

The foregoing objects are realized in a changeable character display device that includes a plurality of flexible strips. Each of the strips has a series of display portions arranged longitudinally thereon. A guide means is provided for guiding a respective display portion of each of the flexible strips into a laterally spaced and viewable first row. The guide means is further effective for clustering together the non-displayed portions of the flexible strips. As a result of this arrangement, a further row of changeable characters may be incorporated into the display device and may be vertically spaced from the first-mentioned row by close spacing.

Simplification of device design is achieved through the clustering arrangement of the flexible strips by the guide means. In a preferred form of the invention, the guide means includes a laterally-extending channel in which the flexible strips are clustered. Hence, no complex arrangement is required for manipulation or storage of the non-displayed portions of the flexible strips.

Alignment apertures are preferably provided in the flexible strips to permit easy and rapid changing of the characters that are viewable. These alignment apertures may cooperate with a display window such that the changing of a displayed character on a flexible strip is accomplished simply by inserting a pointed instrument into an alignment aperture and laterally moving the instrument until it abuts an adjacent lateral edge of the display window.

BRIEF DESCRIPTION OF THE DRAWINGS

The above objects as well as other objects of this invention shall become readily apparent after reading the following description of the accompanying drawings in which.

DESCRIPTION OF THE PREFERRED EMBODIMENTS

Figure 1:
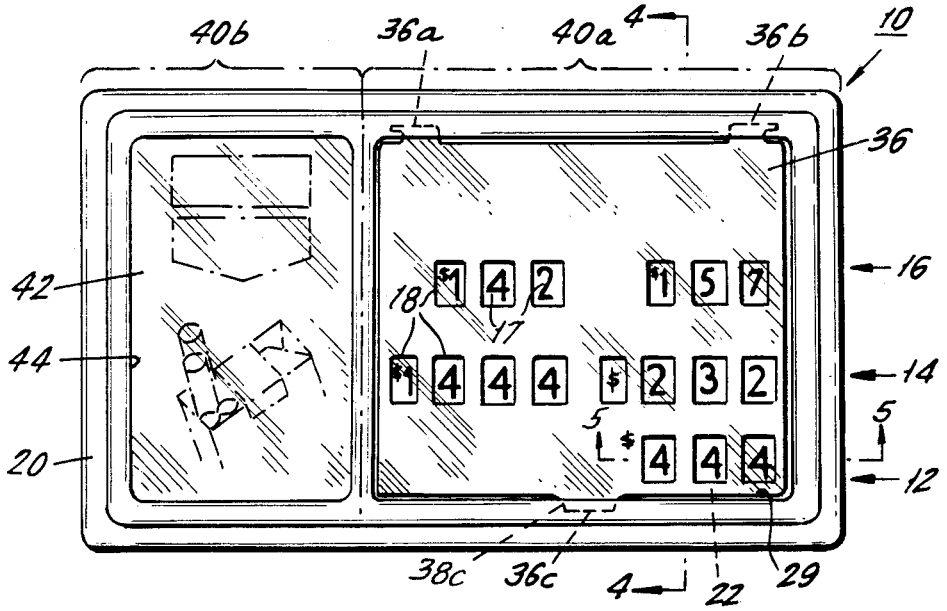
FIG. 1 is a front view of a changeable character display device of the invention.

FIG. 1 illustrates a front view of a changeable character display device 10 in accordance with the invention. In device 10, three lateral rows of display characters 12, 14 and 16 are provided. As will become more apparent hereinafter, adjacent pairs of rows 12, 14 and 16 may be spaced close to each other. Accordingly, display device 10 may include a multiplicity of display characters.

Individual characters 17 that are viewable from the front of display device 10 are formed on respective, separate flexible strips 18.

Figure 2:
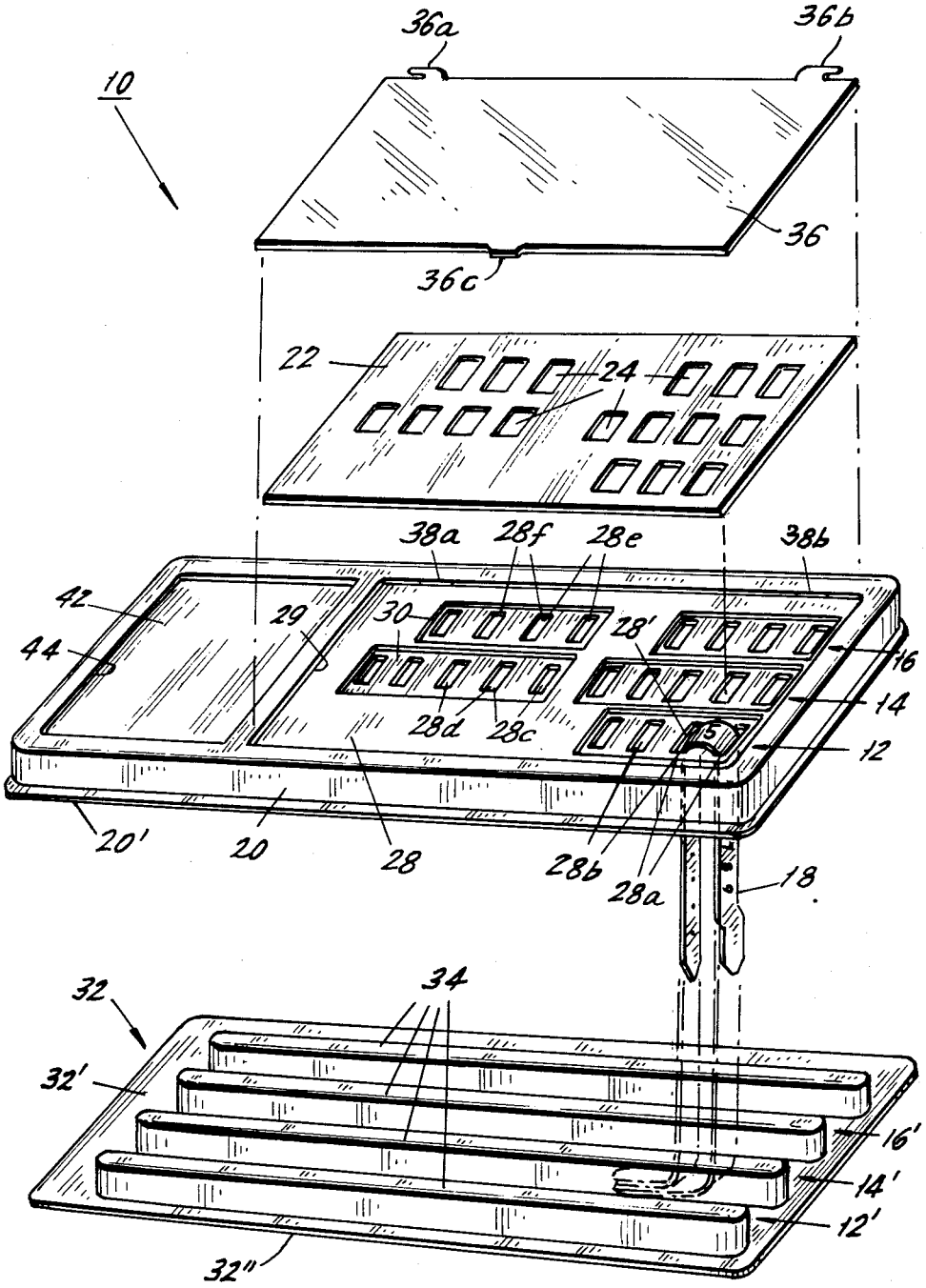
FIG. 2 is an exploded view of the device of FIG. 1.

An exploded view of display device 10 is shown in FIG. 2. Device 10 includes a housing 20 and may include a mask panel 22 adapted to be affixed to the housing 20. Mask panel 22 has a plurality of display windows 24. The characters 17 of flexible strips 18 are viewable through the windows 24 from the front of device 10, as viewed in FIG. 1.

Housing 20 includes a generally planar guide panel 28 used for guiding strips 18 so that selected characters 17 are viewable from the front of the device 10. Guide panel 28 includes pairs of respective, laterally-spaced apertures 28*a*, 28*b*, 28*c*, 28*d*, 28*e* and 28*f*, for example. A respective flexible strip 18 is illustrated at the lower right portion of the housing 20. The strip 16 includes a displayed portion, situated above guide panel 28, and a pair of non-displayed portions respectively extending downwardly through the pair of spaced apertures 28*a*.

It is preferred for simplicity that pairs of apertures in guide panel 28 that are laterally adjacent to each other, such as apertures 28*a* and 28*b*, include a common aperture, such as aperture 28' situated between laterally-adjacent pairs of apertures 28*a* and 28*b*. The pairs of apertures 28*a*, 28*b* and so on preferably comprise vertically-extending slots, as illustrated, for compactness of design.

The guide panel 28 preferably include recesses 30, extending downwardly, as viewed in FIG. 2. The laterally-spaced pairs of apertures 28*a*, 28*b* and so on are situated in the recesses 30. Recesses 30 provide room for the strips 18 to be easily moved to change a displayed character when the mask panel 22 is affixed to the guide panel 28.

The mask panel 22 and guide panel 28 are preferably formed of molded plastic. The panels 22 and 28 may be adhered to each other by conventional means, such as by application of a plastic solvent to the confronting surfaces of the panels 22 and 28.

A guide channel member 32 is included in the device 10. The channel member 32 includes a plurality of ribs 34 oriented laterally and parallel to each other. The ribs 34 extend toward the guide panel 28 from a flat base portion 32'. Channels 12', 14' and 16' are defined between respective, adjacent pairs of channels 34 and correspond to the display rows 12, 14 and 16 illustrated in connection with housing 20. Each guide channel 12' 14' and 16' is adapted to receive the loose ends of the flexible strips 18 of a respective lateral row 12, 14 or 16. Only one strip 18 is shown in FIG. 2, however, for clarity of illustration. The loose ends of strips 18 that are received in the channels 12', 14' and 16' extend to the left in FIG. 2. The strips 18 thus become clustered atop one another, at least in a typical display device 10 where the flexible strips 18 are long in comparison with the displayed portions of the strips.

The guide channel member 32 is preferably comprised of molded plastic, and is adapted to be attached to housing 20. Specifically, a peripheral edge 32" of the guide channel member 32 is dimensioned to be received within a peripheral extension 20' of the housing 20. The guide channel member 32 may be bonded to the housing 20 in any conventional manner.

A transparent cover plate 36, preferably of plastic, may be provided in the display device 10 to cover the viewable portions of the flexible strips 18. The plate 36 prevents the flexible strips 18 from being accidentally moved, and thereby avoids unintended changes of displayed information. The cover plate 36 has top hinges 36*a* and 36*b* which are respectively received into apertures 38*a* and 38*b* in the housing 20. Transparent plate 36 may also include a lower tab 36*c* that may be received into an aperture 38*c*, shown in FIG. 1.

Referring particularly to FIG. 1, the device 10 includes a character display portion 40*a* and a storage portion 40*b*. The left-extending portions of the flexible strips 18 are contained within storage portion 40*b*. Beneficially, the storage portion 40*b*, in which changeable characters are not displayed, may be provided with meaningful indicia viewable from the front of the device, such as pertinent advertising information. Such indicia may be provided on a sheet 42 of plastic, for example, that is alignedly received into a recess 44 in the housing 20. Thus, indicia tailored for a particular application may be conveniently provided on the sheet 42, with other parts of the display device being mass producible.

Figure 3:
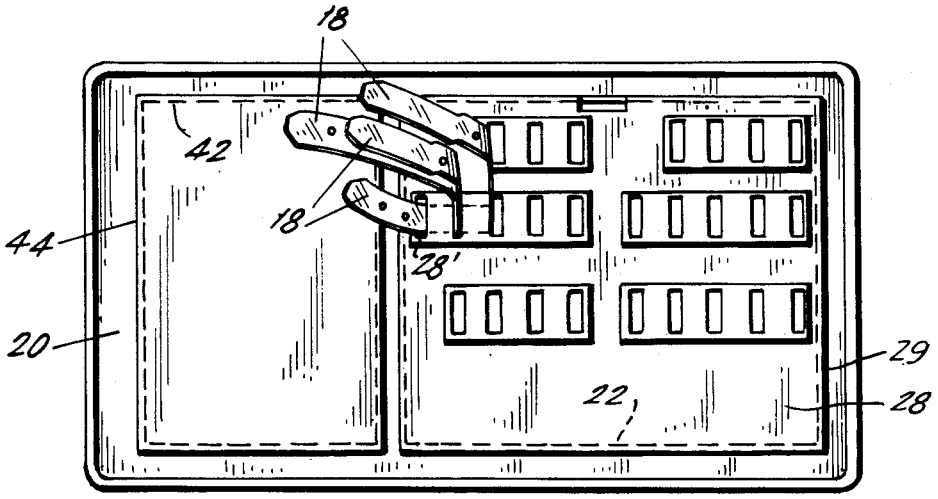
FIG. 3 is a rear view of a housing of the device of FIG. 1.

FIG. 3 shows the rear of housing 20, and, in particular, illustrates the underside of recess 44 in which advertising panel 42 is placed. FIG. 3 also shows a rear view of guide panel 28, and illustrates the underside of recess 29 of the guide panel 28. The illustrated recesses 29 and 44 may be similar to each other in height and depth.

Additionally shown in FIG. 3 are a pair of flexible strips 18 that are passed through apertures 28' of guide panel 28.

Figure 4:
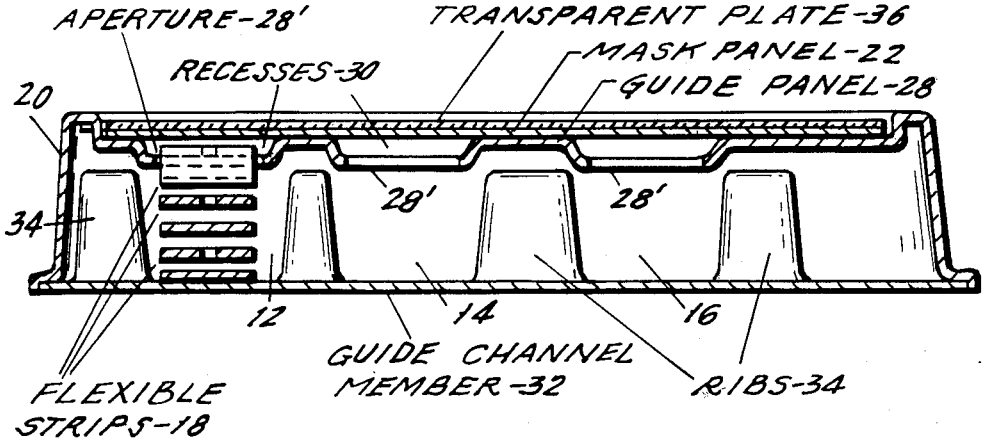
FIG. 4 is a cross-sectional view taken at lines 4—4 in FIG. 1.

FIG. 4 shows the manner in which the flexible strips 18 are clustered together between adjacent ribs 34 of guide channel member 32. Only the flexible strips 18 of row 12 are shown. FIG. 4 also shows the recesses 30 in the guide panel 28, which permit the flexible strips to slide between the mask panel 22 and the guide panel 28.

Figure 5:
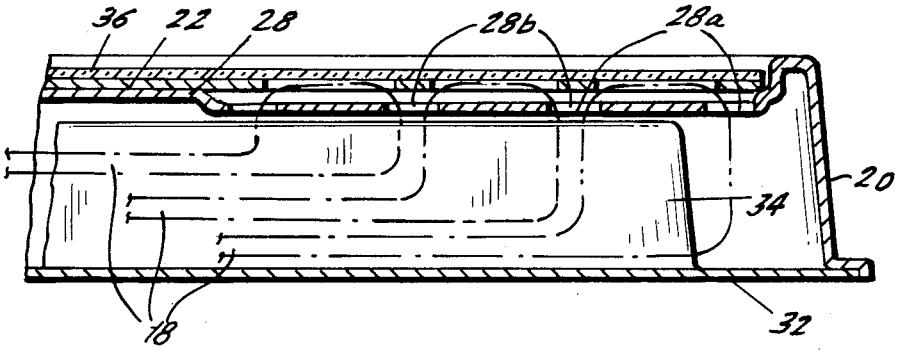
FIG. 5 is a further cross-sectional view taken at lines 5—5 in FIG. 1 and is shown in enlarged form for clarity of illustration.

FIG. 5 further illustrates the clustering of flexible strips 18, which are schematically shown in broken lines. As can be appreciated from FIG. 5, the non-displayed portions of the flexible strips 18 are each directed to the left as viewed in FIG. 5, and are clustered atop one another such that the ends of the strips are generally coplanar to the guide panel 28.

Figure 6:
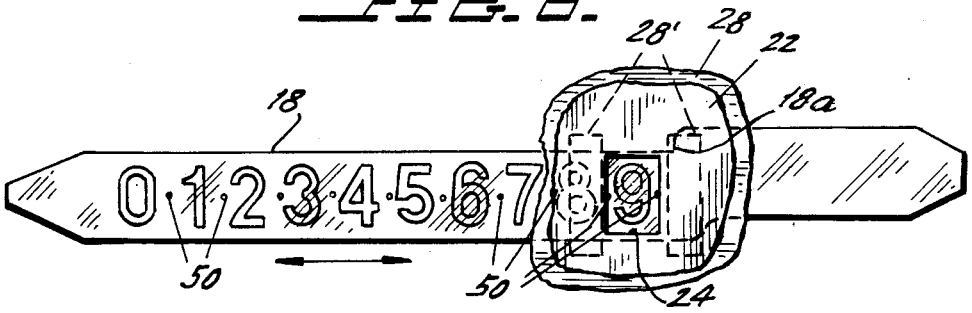
FIG. 6 is a detail view of a flexible strip utilizing the device of FIG. 1 together with a fragment of associated display structure.

FIG. 6 illustrates various features of a flexible strip 18 that is preferably used in the display device of the invention. The strip 18 is shown in conjunction with fragmentary portions of the mask panel 22 and the guide panel 28. The strip is shown as passing through slots 28' in the guide panel 28. A portion of the flexible strip 18 is viewable through a display window 24 in the mask panel 22. The window 24 permits viewing of respective characters on the flexible tape 18 between the laterally-spaced apertures or slots 28'.

The flexible tape 18 is shown in FIG. 6 as essentially flat, with the non-displayed portions respectively extending to the right and to the left. This is only for purposes of illustrating a preferred configuration of the strip 18, but as described above, both non-displayed portions of each flexible tape extend to the left in an assembled display device of the invention.

In a preferred configuration of the flexible strip 18, a vertical projection or stop portion 18*a* is included to prevent movement of the strip to the left when the stop portion 18*a* reaches the right-hand slot 28'. The flexible strip 18 is too wide at the location of stop 18 to fit through the slot.

In accordance with a further feature of the flexible strip 18, apertures 50 are provided in the tape, such as by punching. Each aperture 50 is located between a respective pair of adjacent display characters. Display window 24 is dimensioned laterally such that apertures 50 on either side of a displayed character are respectively located just within the lateral edges of the display window. This facilitates changing of the displayed character of the flexible tape 18. Specifically, the insertion of a pointed instrument (not shown) into the left-hand aperture 50 in the display window 24, for example, followed by movement of such instrument to the right until it abuts the right-hand edge of window 24 results in the display of a different character of the strip. In particular, the numeral "8" of the illustrated tape would next become viewable. The use of apertures 50 for changing displayed characters thus achieves easy, rapid and accurate changing of displayed characters.

The flexible strip 18 is preferably formed of flat material that is uniformly flexible along its longitudinal axis, at least in a direction orthogonal to the plane of the tape when it is lying flat. Accordingly, the flexible strip 18 may be cut from flat stock, and does not require prestressing treatment for use in the present display device. The flexible strip 18 may comprise a thin sheet of plastic, by way of example.

The foregoing describes a changeable character display device which may include a plurality of lateral rows of displayed characters. Vertically-adjacent rows may be spaced proximate to each other to achieve compactness in size. The display device is simple in construction, easy to assemble, and is mass producible. The changing of the displayed characters may be accomplished in an easy, rapid and accurate fashion.

Although the present invention has been described in connection with a plurality of preferred embodiments thereof, many variations and modifications will now become apparent to those skilled in the art. For example, the orientations "vertical" and "lateral" as used herein are interchangeable. Accordingly, a display device of the invention may provide a vertical row of displayed characters, with the associated flexible strips being vertically oriented. It is preferred, therefore, that the present invention be limited not by the specific disclosure herein, but only by the appended claims.

What is claimed is:

1. A changeable character display device, comprising:

a plurality of flexible strips each having two longitudinal ends, each of said strips having a series of longitudinally-arranged display portions between its ends; and guide means for directing a respective display portion of each of said flexible strips into a laterally spaced row that is viewable from a location in front of the display device, said guide means including a panel with a plurality of pairs of apertures arranged laterally in a row, each of said pairs of apertures being associated with a respective one of said flexible strips; and each of said flexible strips being arranged to have a viewable display portion situated in front of and between the individual ones of said associated pair of apertures, while the non-displayed portions of said respective flexible strips are extended rearwardly through said associated pair of apertures;

said guide means being additionally operative for clustering together the non-displayed portions of said strips in a generally lateral orientation and with the ends of the strips being generally parallel to said guide panel.

2. The display device of claim 1, wherein said guide means includes a means for housing said non-displayed portions of said flexible strips in a clustered arrangement.

3. The display device of claim 2, wherein said housing means comprises a pair of confronting walls defining a channel into which said non-displayed portions of said flexible strips are clustered.

4. The display device of claim 1, wherein adjacent pairs of said apertures have a common aperture between them.

5. The display device of claim 1, wherein said guide panel is generally planar.

6. The display device of claim 1, wherein said apertures each comprise a vertically-extending slot.

7. The display device of claim 1, wherein said guide means further includes a mask panel mounted on said guide panel and having a plurality of display windows laterally arranged in a row, said windows framing viewable portions of said flexible strips.

8. The display device of claim 7, wherein said guide means includes a bonding medium situated between and bonding together said mask panel and said guide panel.

9. The display device of claim 7, wherein:

said display windows have confronting lateral edges;

said flexible strips have laterally spaced apertures, with one aperture being situated between each adjacent pair of said display portions of said strips; and adjacent ones of said alignment apertures are laterally spaced apart to such an extent that when a respective displayed portion of one of said flexible strips is viewable, the associated pair of adjacent alignment apertures are respectively situated just within the lateral edges of said display windows, whereby changing of said displayed portions of a flexible strip may be accomplished by inserting a pointed instrument into an alignment aperture of the strip and laterally moving the instrument until it abuts the adjacent lateral edge of the associated display window.

10. The display device of claim 1, wherein said flexible strips are uniformly flexible along their longitudinal axes.

11. The display device of claim 10, wherein said flexible strips comprise flat stock.

12. The display device of claim 1, wherein said flexible strips have laterally-spaced alignment apertures, said apertures being respectively situated between respective adjacent pairs of said display portions of said strips.

13. The display device of claim 1, wherein said flexible strips each have a stop portion projecting orthogonally from the longitudinal axes of said strips.

* * * * *